US009653818B2

(12) United States Patent
Mohammadian et al.

(10) Patent No.: US 9,653,818 B2
(45) Date of Patent: May 16, 2017

(54) ANTENNA STRUCTURES AND CONFIGURATIONS FOR MILLIMETER WAVELENGTH WIRELESS COMMUNICATIONS

(71) Applicant: QUALCOMM Incorporated, San Diego, CA (US)

(72) Inventors: Alireza Hormoz Mohammadian, San Diego, CA (US); Mohammad Ali Tassoudji, San Diego, CA (US); Yu-Chin Ou, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 0 days.

(21) Appl. No.: 14/842,675

(22) Filed: Sep. 1, 2015

(65) Prior Publication Data

US 2016/0248169 A1 Aug. 25, 2016

Related U.S. Application Data

(60) Provisional application No. 62/119,744, filed on Feb. 23, 2015.

(51) Int. Cl.
*H01Q 21/28* (2006.01)
*H01Q 21/06* (2006.01)
(Continued)

(52) U.S. Cl.
CPC ..... *H01Q 21/065* (2013.01); *H01Q 1/243* (2013.01); *H01Q 5/20* (2015.01); *H01Q 5/307* (2015.01);
(Continued)

(58) Field of Classification Search
CPC .... H01Q 21/065; H01Q 21/28; H01Q 9/0407; H01Q 5/20; H01Q 1/243; H01Q 5/48;
(Continued)

(56) References Cited

U.S. PATENT DOCUMENTS 5,262,791 A 11/1993 Tsuda et al.
6,175,333 B1 1/2001 Smith et al.
(Continued)

FOREIGN PATENT DOCUMENTS

EP 2521222 A1 11/2012

OTHER PUBLICATIONS

Deshmukh et al., "Compact Broadband C-Shaped Stacked Microstrip Antennas," 2002 IEEE Antennas and Propagation Society International Symposium, vol. 2, Jun. 16-21, 2002, pp. 538-541, ISBN 0-7803-7330-8, XP_10591755A, Institute of Electrical and Electronics Engineers.

(Continued)

*Primary Examiner* — Hoang Nguyen
(74) *Attorney, Agent, or Firm* — Holland & Hart

(57) ABSTRACT

Methods, systems, and apparatuses are described for wireless communication using the mmW spectrum. In particular, antenna structures may include arrays of antenna elements to deal with line-of-sight issues. Further, antenna structures may be configured to produce a beam (e.g., signal) that is relatively narrow and has a relatively high gain to deal with losses, such as mentioned above. Still further, antenna structures may be configured to provide beam steering (e.g., beamforming) capability. Such antenna structures may be designed to be relatively compact to deal with the limited real estate available on modern wireless communication devices (e.g., cellular telephones).

23 Claims, 9 Drawing Sheets

(51) Int. Cl.

| | |
|---|---|
| ***H01Q 9/04*** | (2006.01) |
| ***H01Q 5/20*** | (2015.01) |
| ***H01Q 1/24*** | (2006.01) |
| ***H01Q 9/26*** | (2006.01) |
| ***H01Q 5/307*** | (2015.01) |
| ***H01Q 5/48*** | (2015.01) |
| *H01Q 1/38* | (2006.01) |
| *H01Q 3/30* | (2006.01) |
| *H01Q 9/06* | (2006.01) |

(52) U.S. Cl.
CPC ..... *H01Q 5/48* (2015.01); *H01Q 9/0407* (2013.01); *H01Q 9/0414* (2013.01); *H01Q 9/26* (2013.01); *H01Q 21/062* (2013.01); *H01Q 21/28* (2013.01); *H01Q 1/38* (2013.01); *H01Q 3/30* (2013.01); *H01Q 9/065* (2013.01)

(58) Field of Classification Search
CPC ..... H01Q 9/0414; H01Q 9/26; H01Q 21/062; H01Q 5/307; H01Q 9/065; H01Q 3/30
See application file for complete search history.

(56) References Cited

U.S. PATENT DOCUMENTS

| | | | | |
|---|---|---|---|---|
| 6,771,221 | B2 | 8/2004 | Rawnick et al. | |
| 7,034,753 | B1 | 4/2006 | Elsallal et al. | |
| 7,830,312 | B2 | 11/2010 | Choudhury et al. | |
| 8,063,840 | B2 | 11/2011 | Matthews et al. | |
| 8,754,824 | B2 | 6/2014 | Puente et al. | |
| 2005/0062673 | A1* | 3/2005 | Wu | H01Q 1/246 343/872 |
| 2009/0224995 | A1 | 9/2009 | Puente et al. | |
| 2010/0283702 | A1 | 11/2010 | Lindmark et al. | |
| 2013/0050056 | A1 | 2/2013 | Lee et al. | |
| 2016/0204509 | A1* | 7/2016 | Zhai | H01Q 5/55 343/725 |

OTHER PUBLICATIONS

ISA/EPO, International Search Report and Written Opinion of the International Searching Authority, Int'l. App. No. PCT/US2016/017671, May 3, 2016, European Patent Office, Rijswijk, NL, 17 pgs.
Kim et al., "60 and 28GHz Delay Spread Measurements and Simulation at Indoor," 2014 International Conference on Information and Communication Technology Convergence (ICTC), Busan, Oct. 22-24, 2014, pp. 148-150, ISBN 978-1-4799-6786-5, XP_32704683A, Institute of Electrical and Electronics Engineers.
IPEA/EP, Second Written Opinion of the International Preliminary Examining Authority, Int'l Application No. PCT/US2016/017671, Feb. 2, 2017, European Patent Office, Rijswijk, NL, 11 pgs.
Kumar et al., "Broadband Microstrip Antennas" In: "Broadband Microstrip Antennas," Jan. 1, 2003, 432 pgs, XP055337084, Artech House, Norwood, MA, USA.

* cited by examiner

300

400-a

ANTENNA STRUCTURES AND CONFIGURATIONS FOR MILLIMETER WAVELENGTH WIRELESS COMMUNICATIONS

CROSS REFERENCES

The present Application for Patent claims priority to U.S. Provisional Patent Application No. 62/119,744 by Mohammadian et al., entitled "Antenna Structures and Configurations for Millimeter Wavelength Wireless Communications," filed Feb. 23, 2015, assigned to the assignee hereof, and expressly incorporated by reference herein.

BACKGROUND

Field of the Disclosure

The present disclosure, for example, relates to wireless communication systems, and more particularly to antenna structures for wireless communications.

Description of Related Art

Wireless communication systems are widely deployed to provide various types of communication content such as voice, video, packet data, messaging, broadcast, and so on. These systems may be multiple-access systems capable of supporting communication with multiple users by sharing the available system resources (e.g., time, frequency, and power). Examples of such multiple-access systems include code-division multiple access (CDMA) systems, time-division multiple access (TDMA) systems, frequency-division multiple access (FDMA) systems, and orthogonal frequency-division multiple access (OFDMA) systems.

By way of example, a wireless multiple-access communication system may include a number of base stations, each simultaneously supporting communication for multiple communication devices, otherwise known as user equipments (UEs). A base station may communicate with UEs on downlink channels (e.g., for transmissions from a base station to a UE) and uplink channels (e.g., for transmissions from a UE to a base station).

Communication systems may employ a licensed spectrum, an unlicensed spectrum, or both. The unlicensed millimeter wavelength (mmW) spectrum in the higher gigahertz (GHz) band (e.g., around 28 GHz or around 60 GHz) is becoming a promising technology, for example, for multi-gigabit wireless communication. Compared to other lower frequency systems (e.g., 800 MHz, 900 MHz, 1800 MHz, 1900 MHz, 2100 MHz, etc.), the spectrum around 60 GHz holds several advantages including an increased unlicensed bandwidth, compact size of a transceiver due to small wavelength (about 5 mm), and less interference due to high atmospheric absorption. However, there are several challenges associated with this spectrum, such as reflection and scattering losses, high penetration loss and high path loss, which limit the range of coverage at 60 GHz and may lead to comparatively more line-of-sight for signal propagation and successful communications. To overcome such issues, directional transmission may be employed. Thus, a technique known as beamforming utilizing multi-element antenna arrays may be employed for mmW wireless communication.

Even with beamforming, however, communications using the mmW spectrum may benefit from an antenna structure that is designed particularly for such wavelengths. Conventional antenna structures designed for lower frequencies (e.g., 800 MHz, 900 MHz, 1800 MHz, 1900 MHz, 2100 MHz, etc.) may include a single omnidirectional antenna (sometimes two or three for diversity) and may be unsuitable for mmW spectrum applications.

SUMMARY

The described features generally relate to one or more improved systems, methods, and/or apparatuses for wireless communication using the mmW spectrum. In particular, antenna structures may include arrays of antenna elements to deal with line-of-sight issues. Further, antenna structures may be configured to produce a beam (e.g., signal) that is relatively narrow and has a relatively high gain to deal with losses, as is mentioned above. Still further, antenna structures may be configured to provide beam steering (e.g., beamforming) capability. Such antenna structures may be designed to be relatively compact to deal with the limited real estate available on modern wireless communication devices (e.g., cellular telephones).

For example, an antenna structure may include a first array of antenna elements configured to transmit/receive at a first frequency (e.g., around 28 GHz) and a second array of antenna elements configured to transmit/receive at a second frequency (e.g., around 60 GHz). The first frequency may be employed for communications over a wireless wide area network (WWAN) and the second frequency may be employed for communications over a wireless local area network (WLAN). Both the first array and the second array may be situated in respective planar configurations, which may be essentially parallel to each other. The antenna structure also may include one or more arrays of dipole antenna elements. The array(s) of dipole antenna elements may be configured to operate in a direction(s) substantially orthogonal to a direction of operation of the first and second arrays.

An apparatus for wireless communication is described. The apparatus may include a first antenna array comprising a first plurality of antenna elements in a first planar configuration and adapted to send and receive wireless signals in a first frequency range. The apparatus also may include a second antenna array comprising a second plurality of antenna elements in a second planar configuration and adapted to send and receive wireless signals in a second frequency range. The second frequency range may be different from the first frequency range.

The second antenna array may be positioned in a plane that is different from the first antenna array.

Alternatively or additionally, the first planar configuration is parallel to the second planar configuration.

Together, the first and second antenna arrays may form a dual-aperture antenna array.

The first antenna array may include at least two of the first plurality of antenna elements in a first lateral dimension and at least two of the first plurality of antenna elements in a second lateral dimension.

At least one of the first plurality of antenna elements may define an aperture. At least one of the second plurality of antenna elements may be laterally aligned within the aperture and is vertically offset from the aperture. Alternatively, at least one of the second plurality of antenna elements may be laterally adjacent to the aperture and vertically offset from the aperture.

At least one of the first plurality of antenna elements may be a microstrip patch antenna. The microstrip patch antenna may include a first patch element and a second patch element parasitically coupled to the first patch element. The first patch element may define a first aperture. The second patch element may define a second aperture. The first aperture and the second aperture may be laterally aligned and vertically spaced from one another.

The first frequency range may include 27-31 gigahertz. The second frequency range may include 56-67 gigahertz.

At least one of the second plurality of antenna elements may be a microstrip E-patch antenna defining a plurality of planar sections connected by a shared edge.

The second antenna array further may include one or more additional antenna elements positioned in a middle column of the second array.

One or more of the first plurality of antenna elements and one or more of the second plurality of antenna elements may be oriented in a mirror symmetry pattern with respect to one another.

At least some of the second plurality of antenna elements are arranged in a triangular lattice configuration.

The apparatus also may include a ground plane coupled to the first and second antenna arrays. The ground plane may include one or more folded dipoles adapted to send and receive wireless signals in the first frequency range and one or more folded dipoles adapted to send and receive wireless signals in the second frequency range.

The apparatus may be a user equipment (UE) and the first and second antenna arrays may be positioned within the UE.

Each of the first antenna array and the second antenna array may be configured to steer a narrow beam for millimeter wave wireless communication.

The apparatus may include a third antenna array, which may include a third plurality of antenna elements in a third planar configuration and adapted to send and receive wireless signals in the first frequency range. The apparatus also may include a fourth antenna array, which may include a fourth plurality of antenna elements in a fourth planar configuration and adapted to send and receive wireless signals in the second frequency range. The first and second antenna arrays may be configured to send and receive wireless signals in a broadside direction and the third and fourth antenna arrays may be configured to send and receive wireless signals in an end-fire direction.

A method for wireless communication is described. The method may involve operating a first antenna array to send and receive wireless signals in a first frequency range. The first antenna array may include a first plurality of antenna elements in a first planar configuration. The method also may involve operating a second antenna array to send and receive wireless signals in a second frequency range different from the first frequency range. The second antenna array may include a second plurality of antenna elements in a second planar configuration. The first antenna array and the second antenna array are part of a same antenna structure. The method may include these and other features as described above and further herein.

A non-transitory computer-readable medium is described. The medium may store computer-executable code for wireless communication. The code may be executable by a processor to cause a device to: control an antenna structure including a first antenna array of a first plurality of antenna elements in a first planar configuration and a second antenna array of a second plurality of antenna elements in a second planar configuration. Such control may operate the first antenna array to send and receive wireless signals in a first frequency range and operate the second antenna array to send and receive wireless signals in a second frequency range different from the first frequency range. The code may be executable by the processor to cause the device to perform these and other features as described above and further herein.

The foregoing has outlined rather broadly the features and technical advantages of examples according to the disclosure in order that the detailed description that follows may be better understood. Additional features and advantages will be described hereinafter. The conception and specific examples disclosed may be readily utilized as a basis for modifying or designing other structures for carrying out the same purposes of the present disclosure. Such equivalent constructions do not depart from the scope of the appended claims. Characteristics of the concepts disclosed herein, both their organization and method of operation, together with associated advantages will be better understood from the following description when considered in connection with the accompanying figures. Each of the figures is provided for the purpose of illustration and description only, and not as a definition of the limits of the claims.

BRIEF DESCRIPTION OF THE DRAWINGS

A further understanding of the nature and advantages of the present invention may be realized by reference to the following drawings. It should be understood that the drawings and the elements or components illustrated are not necessarily to scale, and are not intended to provide specific dimensions or distances but only examples for the sake of understanding. In the appended figures, similar components or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

DETAILED DESCRIPTION

Figure 1:
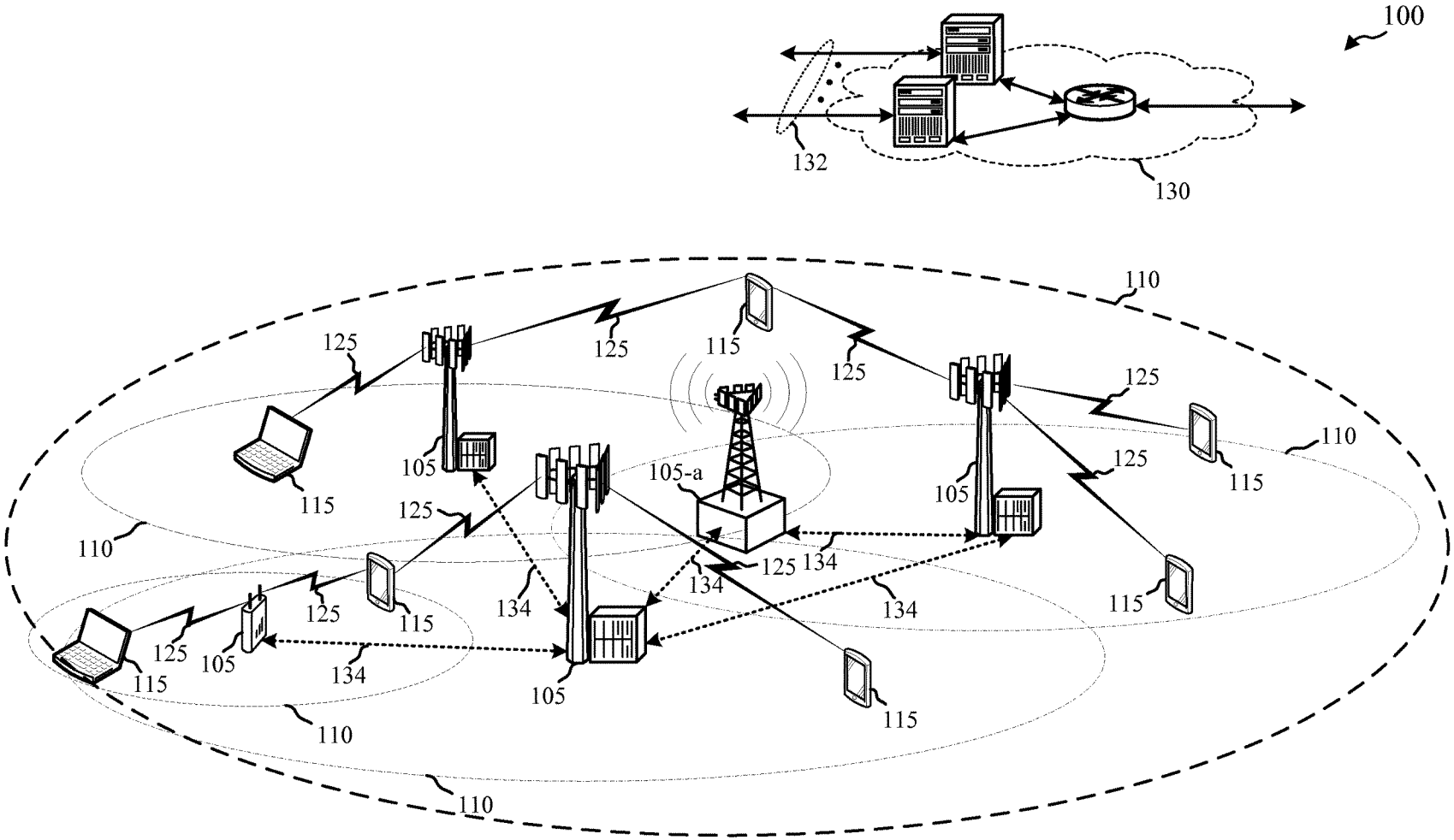
FIG. 1 shows a block diagram of a wireless communication system, in accordance with various aspects of the present disclosure.

As discussed above, mmW communications may benefit from an antenna structure that is designed particularly for such wavelengths. Such an antenna structure may be designed to deal with line-of-sight issues and transmission losses associated with mmW communications. Such an antenna structure may include various features and configurations described herein, such as multiple arrays of antenna elements and/or multiple types of antenna elements. The antenna structure may be designed to produce a relatively narrow beam having a relatively high gain, to provide beam steering capability, and/or to be relatively compact.

One configuration of an antenna structure described herein may include a first array of antenna elements designed to provide coverage in a space above (e.g., in a direction orthogonal to) a plane of the first array. The antenna elements of the first array may be formed by a stacked pair of patches with a lower patch that is fed and an upper patch parasitically coupled to the lower patch.

The antenna structure may include a second array of antenna elements designed to provide coverage in the plane (e.g., in one or more directions parallel to the plane). The antenna elements of the second array may be formed by folded dipoles. The combination of the first and second arrays may be designed to operate at a first frequency (e.g., around 28 GHz).

The antenna structure also may include arrays of antenna elements designed to operate at a second frequency (e.g., around 60 GHz). Such arrays may include a third array of antenna elements designed to provide coverage in the space above the plane and a fourth array of antenna elements designed to provide coverage in the plane.

The antenna elements of the third array may be formed as patches, such as E-patches (patches in the shape of the letter E). The antenna elements of the fourth array may be may be formed by folded dipoles.

The third array of antenna elements may be situated in a same plane as the first array of antenna elements, or in a plane that is essentially parallel to the plane of the first array. The antenna elements of the second array and the elements of the fourth array may be interlaced with each other (e.g., alternating antenna elements of each array). Thus, the antenna elements of the first and third arrays may share essentially the same real estate, and the antenna elements of the second and fourth arrays may share essentially the same real estate, such as described herein.

The following description provides examples, and is not limiting of the scope, applicability, or examples set forth in the claims. Changes may be made in the function and arrangement of elements discussed without departing from the scope of the disclosure. Various examples may omit, substitute, or add various procedures or components as appropriate. For instance, the methods described may be performed in an order different from that described, and various steps may be added, omitted, or combined. Also, features described with respect to some examples may be combined in other examples.

FIG. 1 illustrates an example of a wireless communications system 100 in accordance with various aspects of the disclosure. The wireless communications system 100 includes base stations 105, several user equipment (UE) 115, and a core network 130. The core network 130 may provide user authentication, access authorization, tracking, Internet Protocol (IP) connectivity, and other access, routing, or mobility functions. The base stations 105 interface with the core network 130 through backhaul links 132 (e.g., S1, etc.) and may perform radio configuration and scheduling for communication with the UEs 115, or may operate under the control of a base station controller (not shown). In various examples, the base stations 105 may communicate, either directly or indirectly (e.g., through core network 130), with each other over backhaul links 134 (e.g., X1, etc.), which may be wired or wireless communication links.

The base stations 105 may wirelessly communicate with the UEs 115 via one or more base station antennas. Each of the base station 105 sites may provide communication coverage for a respective geographic coverage area 110. In the example shown, the base stations 105 may utilize the unlicensed millimeter wavelength spectrum and be referred to as mmW base stations (BSs). Further, in this example, the base station 105-*a* may utilize a different radio access technology, such as LTE, and may be referred to as a base transceiver station, a radio base station, an access point, a radio transceiver, a NodeB, eNodeB (eNB), Home NodeB, a Home eNodeB, or some other suitable terminology. The geographic coverage area 110 for a base station 105 may be divided into sectors making up only a portion of the coverage area (not shown). The wireless communications system 100 may include base stations 105 of different types (e.g., macro and/or small cell base stations). There may be overlapping geographic coverage areas 110 for different technologies.

In this example, the wireless communications system 100 is an LTE-assisted mmW wireless access network, although system may be configured solely for mmW communications, as appropriate or desired. The term evolved Node B (eNB) may be generally used to describe the base station 105-*a*, while the term UE may be generally used to describe the UEs 115. The wireless communications system 100 may be a heterogeneous network in which mmW base stations 105 provide coverage for various geographical regions. While a single eNB 105-*a* is shown for simplicity, there may be multiple eNBs 105-*a* that provide the coverage area 110-*a* to cover all or a majority of the UEs 115 within the wireless communications system 100. The coverage areas 110 may indicate communication coverage for a macro cell, a small cell, and/or other types of cell. The term "cell" is a 3GPP term that can be used to describe a base station, a carrier or component carrier associated with a base station, or a coverage area (e.g., sector, etc.) of a carrier or base station, depending on context.

A macro cell generally covers a relatively large geographic area (e.g., several kilometers in radius) and may allow unrestricted access by UEs with service subscriptions with the network provider. A small cell is a lower-powered base station, as compared with a macro cell, that may operate in the same or different (e.g., licensed, unlicensed, etc.) frequency bands as macro cells. Small cells may include pico cells, femto cells, and micro cells according to various examples. A pico cell may cover a relatively smaller geographic area and may allow unrestricted access by UEs with service subscriptions with the network provider. A femto cell also may cover a relatively small geographic area (e.g., a home) and may provide restricted access by UEs having an association with the femto cell (e.g., UEs in a closed subscriber group (CSG), UEs for users in the home, and the like). An eNB for a macro cell may be referred to as a macro eNB. An eNB for a small cell may be referred to as a small cell eNB, a pico eNB, a femto eNB or a home eNB.

An eNB may support one or multiple (e.g., two, three, four, and the like) cells (e.g., component carriers).

The wireless communications system 100 may support synchronous or asynchronous operation. For synchronous operation, the base stations may have similar frame timing, and transmissions from different base stations may be approximately aligned in time. For asynchronous operation, the base stations may have different frame timing, and transmissions from different base stations may not be aligned in time. The techniques described herein may be used for either synchronous or asynchronous operations.

The communication networks that may accommodate some of the various disclosed examples may be packet-based networks that operate according to a layered protocol stack. In the user plane, communications at the bearer or Packet Data Convergence Protocol (PDCP) layer may be IP-based. A Radio Link Control (RLC) layer may perform packet segmentation and reassembly to communicate over logical channels. A Medium Access Control (MAC) layer may perform priority handling and multiplexing of logical channels into transport channels. The MAC layer also may use Hybrid ARQ (HARQ) to provide retransmission at the MAC layer to improve link efficiency. In the control plane, the Radio Resource Control (RRC) protocol layer may provide establishment, configuration, and maintenance of an RRC connection between a UE 115 and the base stations 105 or core network 130 supporting radio bearers for the user plane data. At the Physical (PHY) layer, the transport channels may be mapped to Physical channels.

The UEs 115 are dispersed throughout the wireless communications system 100, and each UE 115 may be stationary or mobile. A UE 115 also may include or be referred to by those skilled in the art as a mobile station, a subscriber station, a mobile unit, a subscriber unit, a wireless unit, a remote unit, a mobile device, a wireless device, a wireless communications device, a remote device, a mobile subscriber station, an access terminal, a mobile terminal, a wireless terminal, a remote terminal, a handset, a user agent, a mobile client, a client, or some other suitable terminology. A UE 115 may be a cellular phone, a personal digital assistant (PDA), a wireless modem, a wireless communication device, a handheld device, a tablet computer, a laptop computer, a cordless phone, a wireless local loop (WLL) station, or the like. A UE 115 may be able to communicate with various types of base stations and network equipment including mmW BSs, macro eNBs, small cell eNBs, relay base stations, and the like.

In the example shown, communication links 125 may include uplink (UL) transmissions from a UE 115 to a mmW base station 105, and/or downlink (DL) transmissions, from a mmW BS 105 to a UE 115. The downlink transmissions also may be called forward link transmissions while the uplink transmissions also may be called reverse link transmissions. Each communication link 125 may include one or more carriers, where each carrier may be a signal made up of multiple sub-carriers (e.g., waveform signals of different frequencies) modulated according to the various radio technologies described above. Each modulated signal may be sent on a different sub-carrier and may carry control information (e.g., reference signals, control channels, etc.), overhead information, user data, etc. The communication links 125 may transmit bidirectional communications using FDD (e.g., using paired spectrum resources) or TDD operation (e.g., using unpaired spectrum resources). Frame structures for FDD (e.g., frame structure type 1) and TDD (e.g., frame structure type 2) may be defined.

In some embodiments of the wireless communications system 100, the mmW BSs 105 and/or the UEs 115 may include antenna structures designed to improve communication quality and reliability between the mmW BSs 105 and UEs 115. Various examples of such antenna structures are described further below.

Figure 2A:
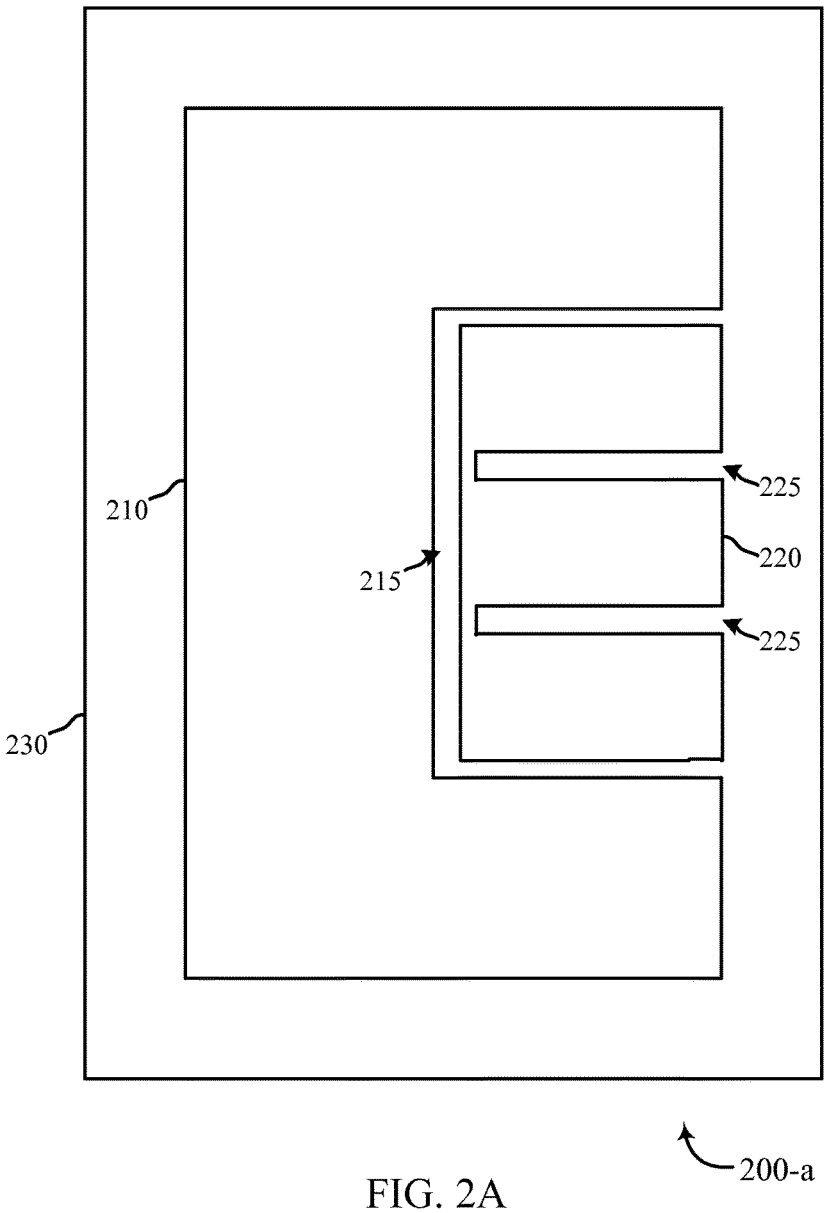
FIGS. 2A and 2B show schematic diagrams of an example of antenna elements, in accordance with various aspects of the present disclosure.

Turning now to FIG. 2A, a schematic diagram 200-*a* is shown illustrating a top view of an example of antenna elements that may be used, for example, in the UEs 115 described with respect to FIG. 1. In this example, a first antenna element 210 and a second antenna element 220 may be disposed on a surface 230 (e.g., ground plane) that includes ports (not shown) for the respective antenna elements 210, 220.

The first antenna element 210 may be formed as a microstrip patch and may be designed to operate at a first frequency (e.g., around 28 GHz). As shown, the first antenna element 210 may be configured to include or define a first aperture 215. As such, the first antenna element 210 may be configured in the shape of the letter C or U as shown. However, it should be understood that other shapes of the first antenna element 210 and the first aperture are possible.

The second antenna element 220 also may be formed as a microstrip patch and may be designed to operate at a second frequency, higher than the first frequency (e.g., around 60 GHz). As shown, the second antenna element 220 may be configured to include or define a pair of apertures 225. As such, the second antenna element 220 may be configured in the shape of the letter E as shown.

Because the operating frequency of the second antenna element 220 is higher than the operating frequency of the first antenna element 210, the second antenna element 220 may be smaller than the first antenna element 210. This may allow the second antenna element 220 to share real estate (e.g., be collocated) with the first antenna element 210. In this example, the second antenna element 220 may be shaped complementary to the shape of the aperture 215 of the first antenna element 210 so as to fit (e.g., aligned) at least partially, if not entirely, in the aperture 215. As with the first aperture 215, it should be understood that other shapes of the second antenna element 220 are possible.

Figure 2B:
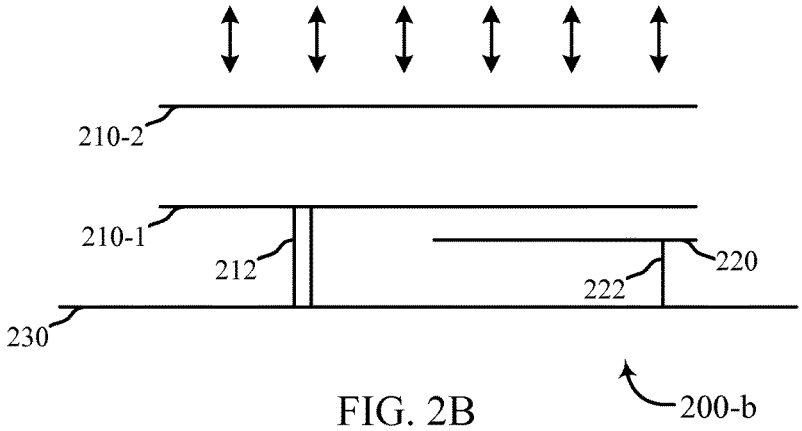

FIG. 2B shows a schematic diagram 200-*b* illustrating a side view of the example of antenna elements shown in FIG. 2A. In this example, the first antenna element 210 may be formed by a lower patch element 210-1 and an upper patch element 210-2 stacked vertically (e.g., orthogonally to the plane of the first antenna element 210). The lower patch element 210-1 may be connected or coupled to a corresponding port (not shown) in the surface 230 (e.g., ground plane) via a first post or conductor 212 such that the lower patch element 210-1 may be fed in operation (e.g., transmission of a communication or other signal). The upper patch element 210-2 may be parasitically coupled to the lower patch element 210-1 in any suitable manner (e.g., sufficiently closely spaced adjacent the lower patch element 210-1 or physically connected).

The second antenna element 220 may be situated below the first antenna element 210 (e.g., below the lower patch element 210-1 as shown). Alternatively, because the second antenna element 220 is smaller and aligned with the aperture 215 as described above with respect to FIG. 2A, the second antenna element 220 may be situated in a plane that is between a plane of the lower patch element 210-1 and a plane of the upper patch element 210-2. As with the first antenna element 210, the second antenna element 220 may be connected or coupled to a corresponding port (not shown) in the substrate 230 via a second post or conductor 222 such that the second antenna element 220 may be fed in operation (e.g., transmission of a communication or other signal).

In the configuration shown, with the first antenna element 210 and the second antenna element 220 disposed in parallel planes, both the first antenna element 210 and the second antenna element 220 may provide coverage (for receiving and/or transmitting signals) in a direction shown by the arrows in FIG. 2B (e.g., orthogonal to the plane(s) of the antenna elements 210, 220). Although not shown for the sake of clarity in FIG. 2B, a substrate material (e.g., a composite material such as FR-4) may fill the volume between the surface 230 and the upper patch element 210-2 (or even over the upper patch element, as appropriate or desired). A substrate material also may be situated under the surface 230.

Figure 3:
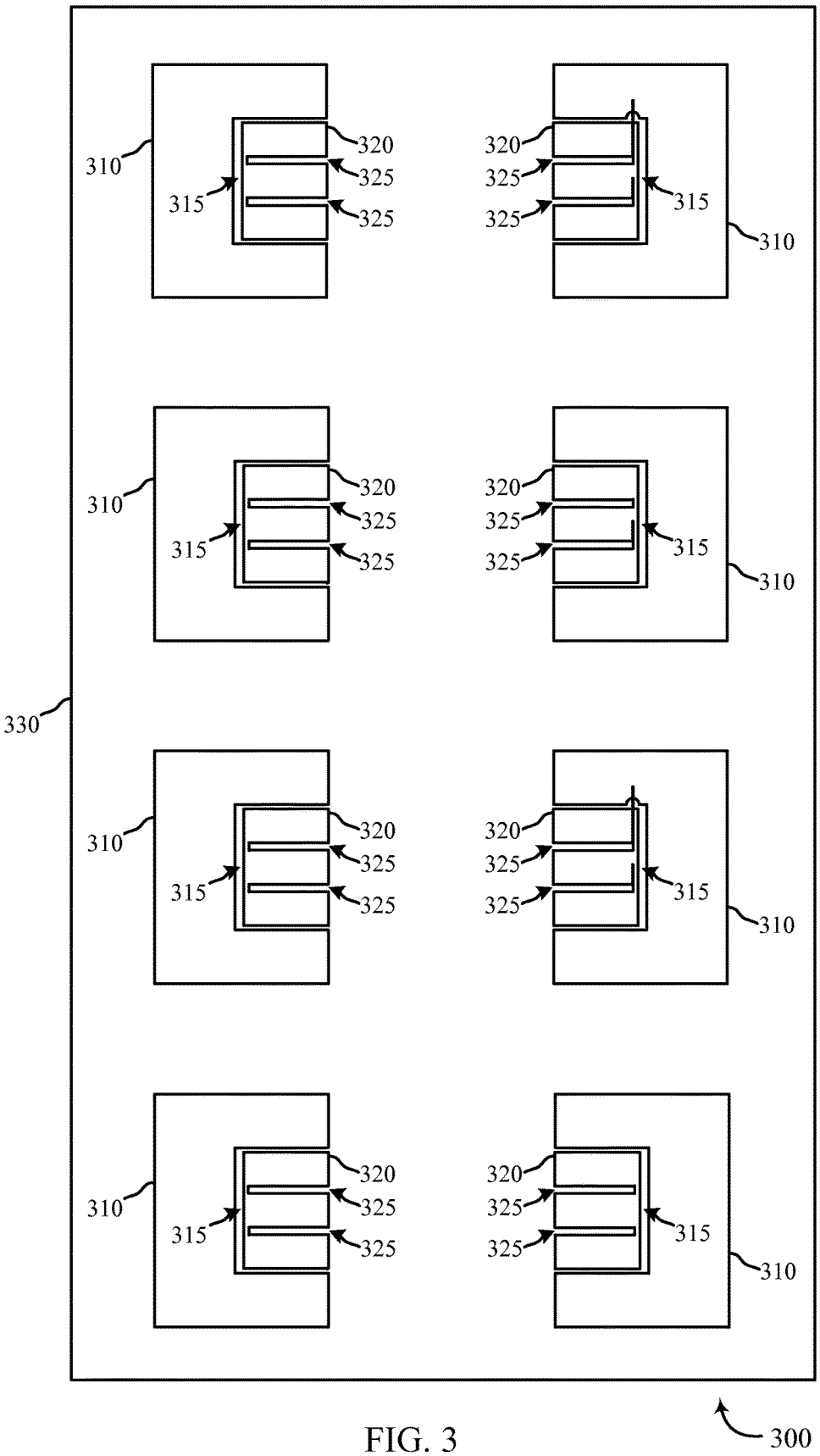
FIG. 3 shows a schematic diagram of an example of a configuration of arrays of antenna elements, in accordance with various aspects of the present disclosure.

FIG. 3 shows a schematic diagram 300 illustrating a top view of an example of an antenna structure, in accordance with various aspects of the present disclosure. In this example, the antenna structure may be configured to include a first array of antenna elements 310, each of which may be an example of the first antenna element 210 described above with respect to FIGS. 2A and/or 2B. Each of the antenna elements 310 may include or define an aperture 315. The antenna elements 310 may be disposed in a 2×4 array, with mirror symmetry (as shown, e.g., translational relationship with rotation) between the four antenna elements 310 on one side and the four antenna elements 310 on the other side. Such mirror symmetry may provide improved isolation for the antenna elements 310. Alternatively, the four antenna elements 310 on one side may be oriented in a same direction (e.g., translational relationship without rotation) as the four antenna elements 310 on the other side.

The antenna structure also may be configured to include a second array of antenna elements 320, each of which may be an example of the second antenna element 220 described above with respect to FIGS. 2A and/or 2B. Each of the antenna elements 310 may include or define a pair of apertures 325. The antenna elements 320 also may be disposed in a 2×4 array, with mirror symmetry (as shown) between the four antenna elements 320 on one side and the four antenna elements 320 on the other side. Alternatively, the four antenna elements 320 on one side may be oriented in a same direction as the four antenna elements 320 on the other side.

As described above with respect to FIG. 2A, the second antenna elements 320 may share real estate (e.g., be collocated) with the first antenna elements 310, for example, by fitting (e.g., aligned) at least partially, if not entirely, in respective apertures 315 of the first antenna elements 310. In the example shown, each second antenna element 320 may be mostly disposed/aligned within a respective aperture 315 of a corresponding first antenna element 310. Each of the first antenna elements 310 and each of the second antenna elements 320 may be disposed on a substrate 330 that includes ports (not shown) for the respective antenna elements 310, 320, such as described above with respect to FIGS. 2A and 2B.

In the antenna structure of FIG. 3, the first antenna elements 310 may be suitably spaced apart. For example, the first antenna elements 310 may be spaced at less than one wavelength (λ) apart (e.g., approximately λ/2) from one another, according to their operating wavelength (e.g., through open air). In this example, having the first antenna elements 310 suitably spaced apart may mean that the second antenna elements 320 may not be ideally spaced apart from one another. Although the opposing second antenna elements 320 of the sets of four antenna elements 320 may be suitably spaced by adjusting how much (e.g., more or less) of each second antenna element 320 is disposed within the respective aperture 315 of the corresponding first antenna element 310, the second antenna elements 320 of the respective sets of four may still be spaced apart from each other non-ideally (e.g., far from λ/2 or even greater than λ).

In the configuration shown, the first antenna elements 310 and the second antenna elements 320 may be disposed in parallel planes. As such, both the first antenna elements 310 and the second antenna elements 320 may provide coverage (for receiving and/or transmitting signals) in a direction upward, out of the page (e.g., orthogonal to the plane(s) of the antenna elements 310, 320). This direction may be referred to as a broadside direction in view of the relatively large footprint of the 2×4 arrays of the antenna elements 310 and 320 on the surface of the substrate 330 (as compared to the areas of the edges of the substrate on which additional arrays of antenna elements may be disposed, as discuss below with respect to FIGS. 5A, 5B and 6).

Figure 4A:
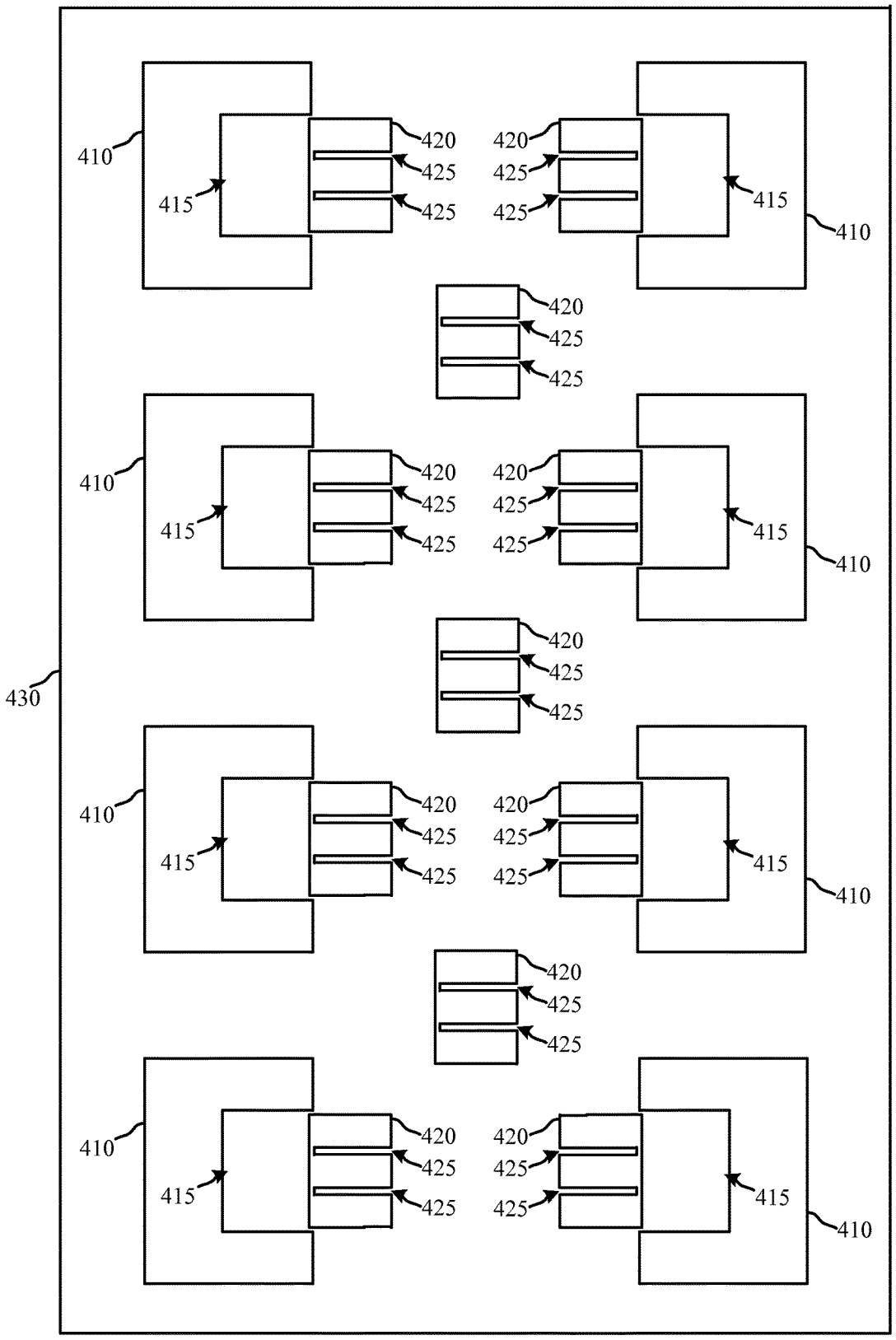
FIG. 4A shows a schematic diagram of another example of a configuration of arrays of antenna elements, in accordance with various aspects of the present disclosure.

FIG. 4A shows a schematic diagram **400-*a* illustrating a top view of another example of an antenna structure, in accordance with various aspects of the present disclosure. In this example, the antenna structure may be configured to include a first array of antenna elements 410, each of which may be an example of the first antenna element 210 described above with respect to FIGS. 2A and/or 2B. Each of the antenna elements 410 may include or define an aperture 415. The antenna elements 410** may be disposed in a 2×4 array, with mirror symmetry (as shown) or oriented in a same direction, as appropriate or desired.

The antenna structure also may be configured to include a second array of antenna elements 420, each of which may be an example of the second antenna element 220 described above with respect to FIGS. 2A and/or 2B. Each of the antenna elements 410 may include or define a pair of apertures 425. The antenna elements 420 may be disposed in a 2×4 array, with mirror symmetry (as shown), with an additional array disposed in between the four antenna elements 420 on each side of the 2×4 array.

As described above with respect to FIG. 2A, the second antenna elements 420 of the 2×4 array may share real estate (e.g., be collocated) with the first antenna elements 410, for example, by fitting (e.g., aligned) at least partially in respective apertures 415 of the first antenna elements 410. Each of the first antenna elements 410 and each of the second antenna elements 420 may be disposed on a substrate 430 that includes ports (not shown) for the respective antenna elements 410, 420, such as described above with respect to FIGS. 2A and 2B.

In the antenna structure of FIG. 4A, the first antenna elements 410 may be suitably spaced apart, such as described above with respect to FIG. 3. In the example shown, each second antenna element 420 of the 2×4 array may be only partially disposed within the respective aperture 415 of the corresponding first antenna element 410. Further, the second antenna elements 420 of the additional array may be situated to form a triangular lattice arrangement of the second antenna elements 420. With the triangular lattice arrangement and second antenna elements 420 only partially disposed within the respective apertures 415 of the corresponding first antenna elements 410, the second antenna elements 420 may be suitably spaced apart (e.g., less than λ, such as approximately λ/2) from one another.

Figure 4B:
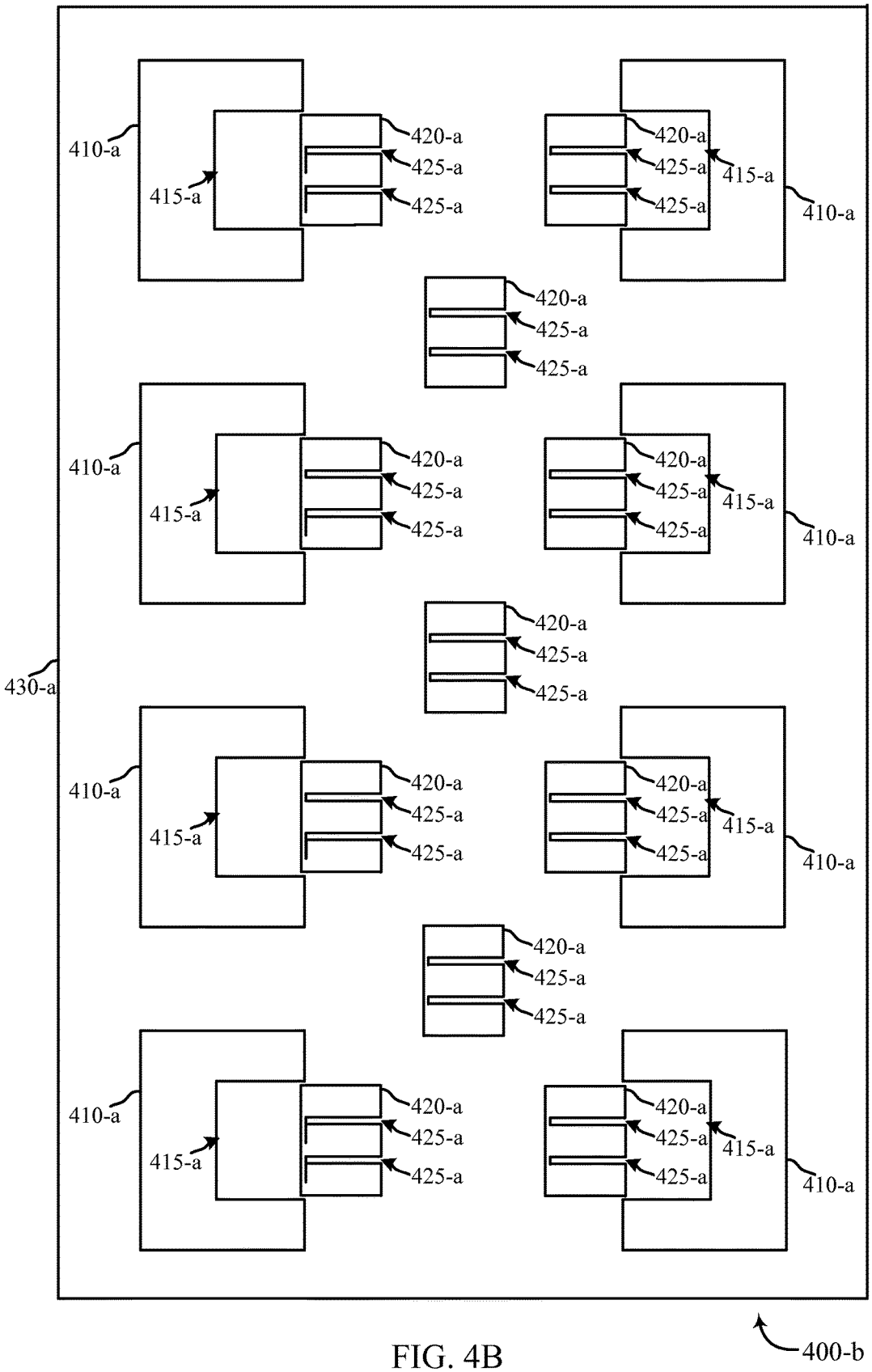
FIG. 4B shows a schematic diagram of yet another example of a configuration of arrays of antenna elements, in accordance with various aspects of the present disclosure.

FIG. 4B shows a schematic diagram **400-*b*** illustrating a top view of a yet another example of an antenna structure, in accordance with various aspects of the present disclosure.

In this example, the antenna structure may be configured similarly to the antenna structure described above with respect to FIG. 4A, including a first array of antenna elements 410-*a* that define respective apertures 415-*a* and a second array of antenna elements 420-*a* that define respective pairs of apertures 425-*a*. Each of the first antenna elements 410-*a* may be an example of the first antenna element 210 described above with respect to FIGS. 2A and/or 2B, and each of the second antenna elements 420-*a* may be an example of the second antenna element 220 described above with respect to FIGS. 2A and/or 2B.

The first antenna elements 410-*a* may be disposed in a 2×4 array, with mirror symmetry (as shown) or oriented in a same direction, as appropriate or desired. The second antenna elements 420-*a* may be disposed in a 2×4 array, oriented in a same direction, with an additional array disposed in between the four antenna elements 420-*a* on each side of the 2×4 array. The second antenna elements 420-*a* of the additional array also may be oriented in a same direction as the other antenna elements 420-*a* (e.g., all second antenna elements 420-*a* situated in a translational relationship without rotation).

Having the antenna elements of the array oriented in the same direction may be considered to be a default or customary orientation. When the array is fed by a feed network (or manifold) such as a corporate feed, then having the antenna elements oriented the same direction may simplify the feed network. However, if each antenna element is fed by a separate Tx/Rx module, then the layout may be managed on a chip. When the first and second antenna elements are in mirror symmetry, then a 180-degree phase shift may be implemented between their feed currents. Such a phase shift may be handled in the digital domain on the chip, for example.

As described above, the second antenna elements 420-*a* of the 2×4 array may share real estate (e.g., be collocated) with the first antenna elements 410-*a*, for example, by fitting (e.g., aligned) at least partially in respective apertures 415-*a* of the first antenna elements 410-*a*. Each of the first antenna elements 410-*a* and each of the second antenna elements 420-*a* may be disposed on a substrate 430-*a* that includes ports (not shown) for the respective antenna elements 410-*a*, 420-*a*, such as described above with respect to FIGS. 2A and 2B.

In the antenna structure of FIG. 4B, the first antenna elements 410-*a* may be suitably spaced apart, such as described above with respect to FIG. 3. In the example shown, each second antenna element 420-*a* of the 2×4 array may be only partially disposed within the respective aperture 415-*a* of the corresponding first antenna element 410-*a*. Further, the second antenna elements 420-*a* of the additional array may be situated to form a triangular lattice arrangement of the second antenna elements 420-*a*, which may be such that the second antenna elements 420-*a* are suitably spaced apart from one another.

Although the examples described above with respect to FIGS. 3, 4A and 4B involve 2×4 arrays of antenna elements, it should be understood that other configurations of arrays (1λ3, 2λ3, 2λ2, 2λ1, etc.) are possible. Further, it should be understood that while more antenna elements may generally lead to higher gain, the real estate (e.g., space) available for the antenna structure (or structures) within a device, such as a UE, is limited by the overall size of the device and the other components thereof.

Figure 5A:
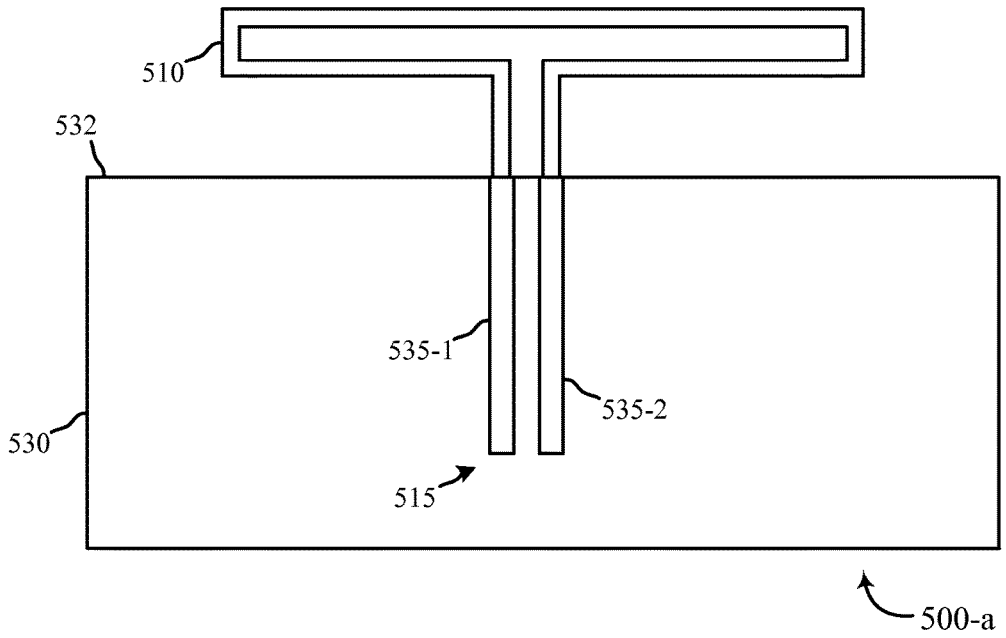
FIG. 5A shows a schematic diagram of an example of a dipole antenna element, in accordance with various aspects of the present disclosure.

Turning now to FIG. 5A, a schematic diagram 500-*a* is shown illustrating a top view of an example of an antenna element that may be used, for example, in the UEs 115 described with respect to FIG. 1. In this example, a dipole antenna element 510 may be disposed on a surface 530 (e.g., ground plane) that includes a port 515 for the dipole antenna element 510.

The dipole antenna element 510 may be configured to be coupled or connected to the port 515, for example, to a first line (e.g., conductor) 535-1 and a second line 535-2 of the port 515. Such a configuration may make the dipole antenna element 510 a balanced antenna element with a differential feed (e.g., the feed current in the first line 535-1 being opposite of the feed current in the second line 535-2). The dipole antenna element 510 may be formed as a folded dipole antenna element and may be designed to operate at a particular frequency (e.g., around 28 GHz). The dipole antenna element 510 may be configured in the general shape of the letter T, for example, with the dipole antenna element 510 extending from an edge 532 of the surface 530 and the top of the T-shape essentially parallel to a plane of the edge 532.

Figure 5B:
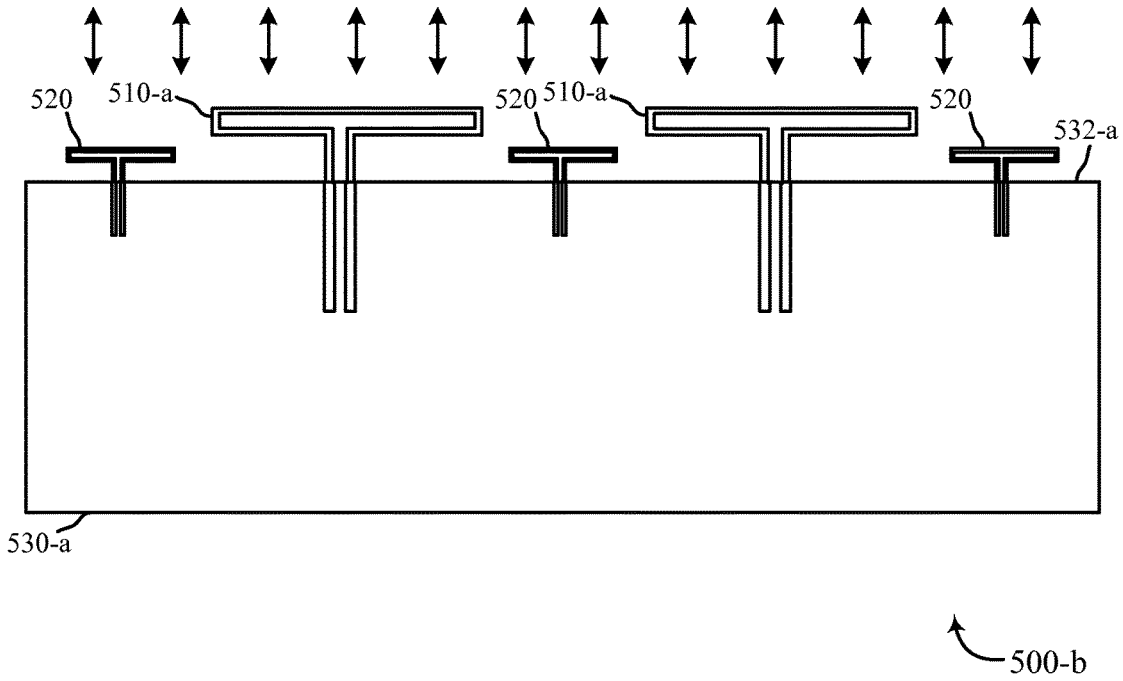
FIG. 5B shows a schematic diagram of an example of a configuration of arrays of dipole antenna elements, in accordance with various aspects of the present disclosure.

FIG. 5B shows a schematic diagram 500-*b* illustrating a top view of an example of antenna elements, each of which may be configured similarly to the antenna element 510 described with respect to FIG. 5A. In this example, a first array of antenna elements 510-*a* may be disposed on a surface 530-*a*, such as described with respect to FIG. 5A, to extend from an edge 532-*a* thereof. Each of the first antenna elements 510-*a* may be a folded dipole antenna element designed to operate at a first frequency (e.g., around 28 GHz).

A second array of antenna elements 520 also may be disposed on the surface 530-*a*, such as described with respect to FIG. 5A. Each of the second antenna elements 520 may be a folded dipole antenna element designed to operate at a second frequency (e.g., around 60 GHz).

The first antenna elements 510-*a* and the second antenna elements 520 may be interlaced with each other (e.g., alternating antenna elements of each array). Because the operating frequency of the second antenna elements 520 is higher than the operating frequency of the first antenna elements 510-*a*, the second antenna elements 520 may be smaller than the first antenna elements 510-*a*. This may allow the second antenna element 220 to share real estate (e.g., be collocated) with the first antenna element 210, by fitting in the space(s) between adjacent first antenna elements 510-*a*.

The second antenna elements 520 may be situated closer to the edge 532-*a* of the surface 530-*a*. Alternatively, because the second antenna elements 520 are smaller and fit within the space(s) between adjacent first antenna elements 510-*a*, the second antenna elements 520 may be situated in a same plane as the first antenna elements 510-*a* (e.g., with the tops of the first and second antenna elements 510-*a*, 520 essentially in the same plane, parallel to the edge 532-*a*). Alternatively or additionally, the first and second antenna elements 510-*a*, 520 may be situated in essentially a same plane parallel to the surface 530-*a*. If the feed lines for the first and second antenna elements 510-*a*, 520 are situated in that same plane, a number of conductive layers (e.g., metal) may be reduced, which may reduce manufacturing costs and/or complexity.

In the configuration shown, with the first antenna elements 510-*a* and the second antenna elements 520 disposed in parallel planes, both the first antenna elements 510-*a* and the second antenna elements 520 may provide coverage (for receiving and/or transmitting signals) in a direction shown by the arrows in FIG. 5B (e.g., orthogonal to the plane of the edge 532-*a* of the surface 530-*a* or in the plane of the surface 530-*a*). This direction may be referred to as an edge or end-fire direction (as compared to the area of the surface on which the arrays of patch antenna elements may be disposed, as discuss above with respect to FIGS. 2A, 2B, 3, 4A and 4B). Although not shown for the sake of clarity in FIG. 5B, a first substrate material (e.g., a composite material such as FR-4) may be situated on a top side of the surface 530-*a* (supporting patch antennas as described above) and a second substrate material (e.g., same) may be situated on a bottom side of the surface 530-*a* (supporting the dipole antenna elements). The feed lines for the dipole antenna elements (not shown) may be disposed on a surface of the second substrate material.

The first antenna elements 510-*a* may be suitably spaced apart (e.g., less than λ or approximately λ/2 corresponding to 28 GHz) from each other. Alternatively, the second antenna elements 520 may be suitably spaced apart from each other. Still further, a compromise between the spacing of the first antenna elements 510-*a* and the spacing of the second antenna elements 520 may be determined. Having the first antenna elements 510-*a* spaced apart approximately λ/2 from each other (center to center of adjacent elements) may provide a small (e.g., minimal) distance between tips of adjacent elements to avoid touching. This may result in a distance of about λ (corresponding to 60 GHz) between adjacent second antenna elements 520, noting that the physical distance of λ/2 at 28 GHz is quite close to λ at 60 GHz.

Figure 6:
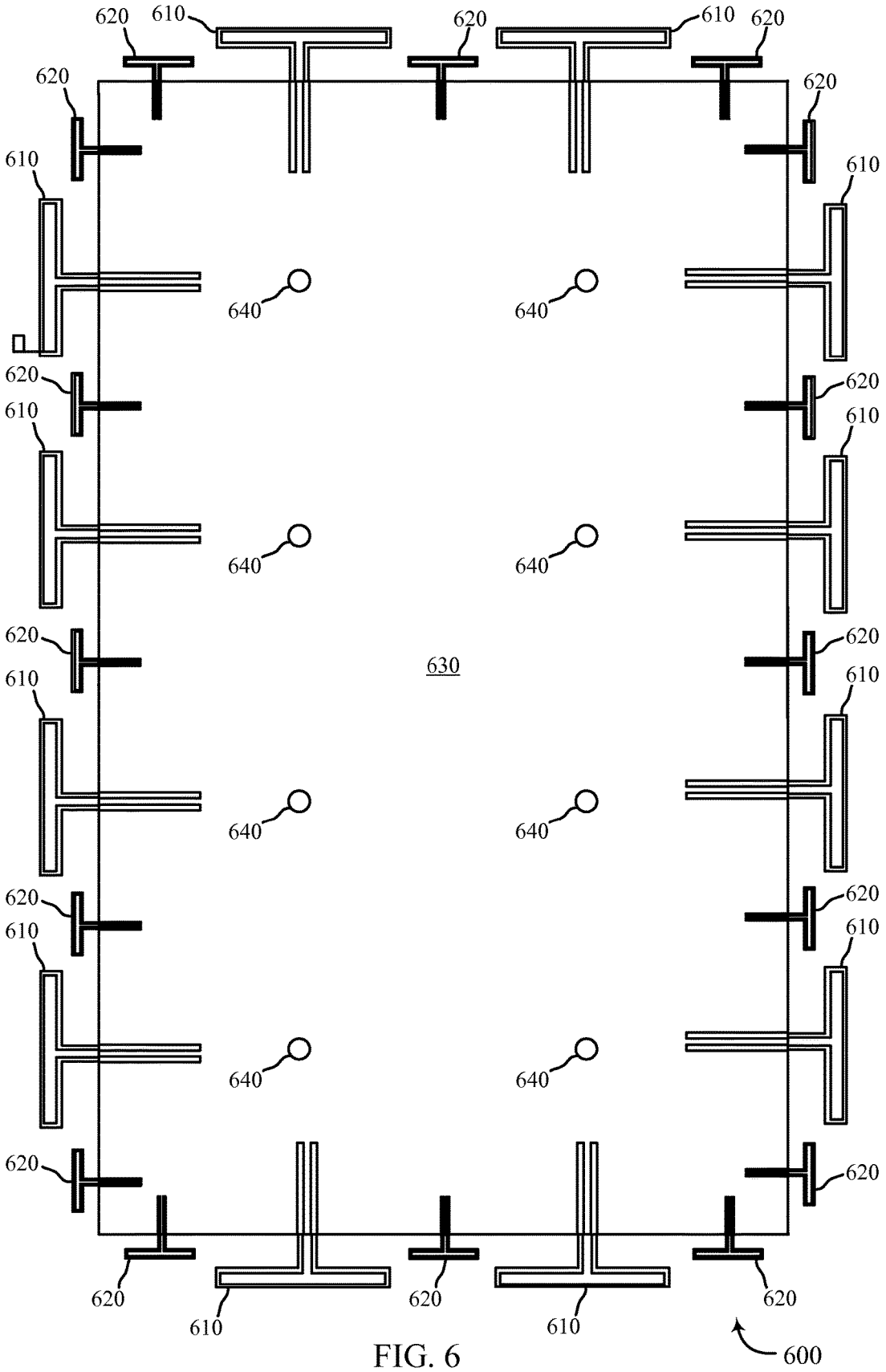
FIG. 6 shows a schematic diagram of another example of a configuration of arrays of dipole antenna elements, in accordance with various aspects of the present disclosure.

FIG. 6 shows a schematic diagram 600 illustrating a top view of an example of an antenna structure, in accordance with various aspects of the present disclosure. In this example, the antenna structure may be configured to include a first array of antenna elements 610, each of which may be an example of the first antenna element 510-*a* described above with respect to FIG. 5B. The antenna structure also may be configured to include a second array of antenna elements 620, each of which may be an example of the second antenna element 520 described above with respect to FIG. 5B.

The first antenna elements 610 and the second antenna elements 620 may be disposed along the edges of a substrate 630, with the first antenna elements 610 and the second antenna elements 620 interlaced. With the rectangular substrate 630 shown in FIG. 6, the arrays may be configured to operate in four different directions, providing coverage in the plane of the substrate 630.

Although not shown for the sake of clarity, additional arrays of antenna elements, such as those described with respect to FIG. 3, 4A or 4B, may be disposed on the substrate 630 as suggested by ports 640 shown in FIG. 6 (e.g., for the first antenna elements 310, 410 or 410-*a*). Thus, it should be understood that the antenna arrays of FIG. 3, 4A or 4B may be combined with the antenna arrays of FIG. 6 to form a compact antenna structure that includes both patch antenna elements and dipole antenna elements for a given frequency, or both patch antenna elements and dipole antenna elements for two different frequencies.

In the examples described above with respect to FIGS. 3, 4A, 4B, 5A, 5B, 5C and 6, the antenna elements of the antenna arrays (either the patch arrays or the dipole arrays, or both) may be designed and arranged in such a way to match to their feed (e.g., their operating frequency). Such an approach may achieve improved return loss and/or isolation characteristics (e.g., better than ten (10) decibels (dB) in some instances).

Figure 7:
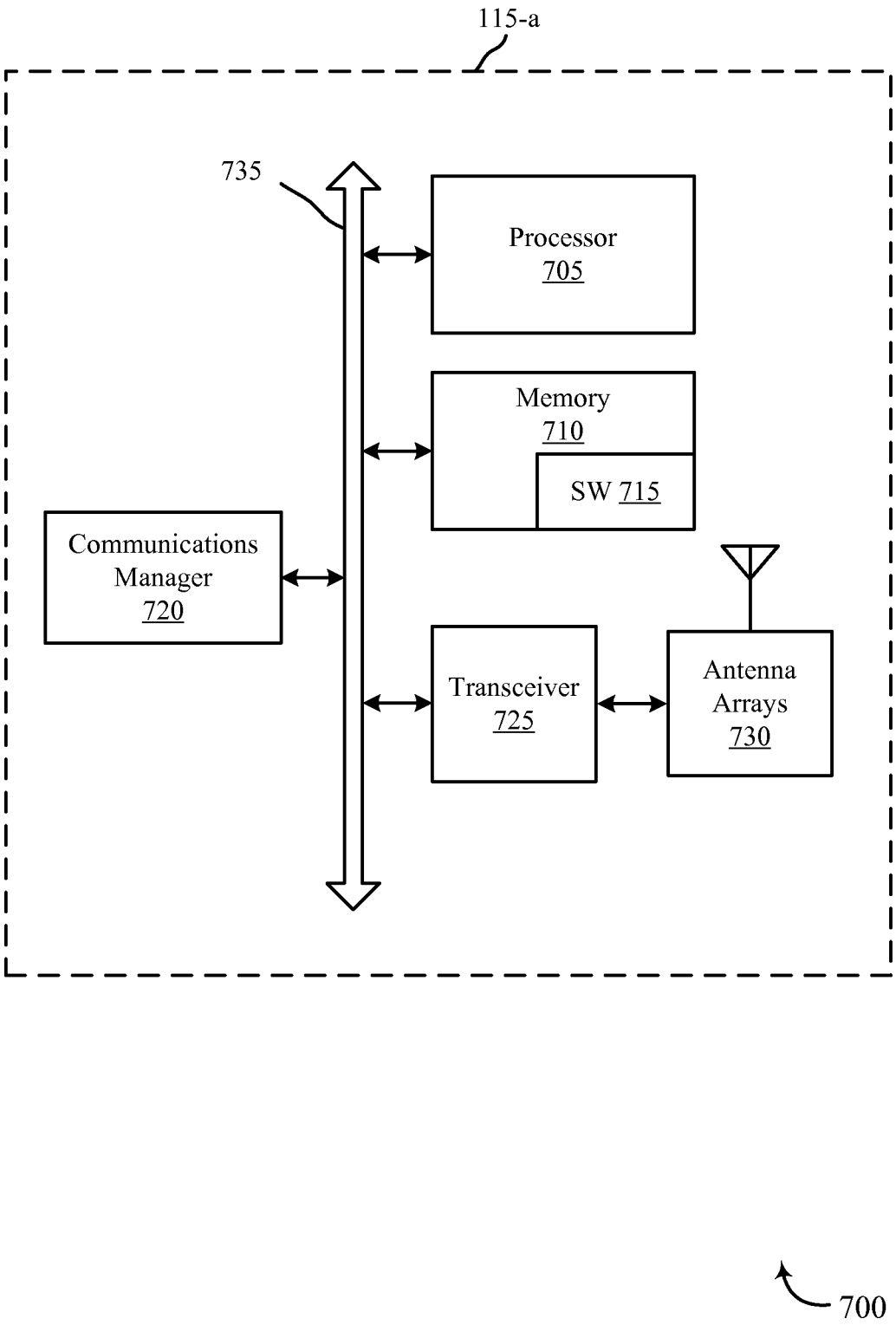
FIG. 7 shows a block diagram of a device configured for use in wireless communication, in accordance with various aspects of the present disclosure.

FIG. 7 shows a block diagram 700 illustrating an example of an architecture for a UE 115-*a* for wireless communications, in accordance with various aspects of the present disclosure. The UE 115-*a* may have various configurations and may be included or be part of a personal computer (e.g., a laptop computer, netbook computer, tablet computer, etc.), a cellular telephone (e.g., a smartphone), a PDA, a digital video recorder (DVR), an internet appliance, a gaming console, an e-reader, etc. The UE 115-*a* may in some cases have an internal power supply (not shown), such as a small battery, to facilitate mobile operation. The UE 115-*a* may be an example of various aspects of the UEs 115 described with reference to FIG. 1. The UE 115-*a* may implement at least some of the features and functions described with reference to FIGS. 1, 2A, 2B, 3, 4A, 4B, 5A, 5B and/or 6. The UE 115-*a* may communicate with a mmW BS 105 described with reference to FIG. 1.

The UE 115-*a* may include a processor 705, a memory 710, a communications manager 720, at least one transceiver 725, and antenna arrays 730. Each of these components may be in communication with each other, directly or indirectly, over a bus 735.

The memory 710 may include random access memory (RAM) and/or read-only memory (ROM). The memory 710 may store computer-readable, computer-executable software (SW) code 715 containing instructions, when executed, cause the processor 705 to perform various functions described herein for wireless communications. Alternatively, the software code 715 may not be directly executable by the processor 705 but may cause the UE 115-*a* (e.g., when compiled and executed) to perform various functions described herein.

The processor 705 may include an intelligent hardware device, e.g., a CPU, a microcontroller, an ASIC, etc. The processor 705 may process information received through the transceiver(s) 725 from the antenna arrays 730 and/or information to be sent to the transceiver(s) 725 for transmission through the antenna arrays 730. The processor 705 may handle, alone or in connection with the communications manager 720, various aspects of wireless communications for the UE 115-*a*.

The transceiver(s) 725 may include a modem to modulate packets and provide the modulated packets to the antenna arrays 730 for transmission, and to demodulate packets received from the antenna arrays 730. The transceiver(s) 725 may in some cases be implemented as transmitters and separate receivers. The transceiver(s) 725 may support communications according to multiple RATs (e.g., mmW, LTE, etc.). The transceiver(s) 725 may communicate bi-directionally, via the antenna arrays 730, with the mmW BS(s) 105 described with reference to FIG. 1. Although not shown, the UE 115-*a* also may include a single antenna or multiple antennas designed to handle RATs other than mmW.

The transceiver(s) 725, either alone or in conjunction with the communications manager 720, may control operations of the antenna arrays 730. Such control may involve individually feeding the antenna elements of the antenna arrays 730 in such a manner to steer beam(s) in desired direction(s). For example, for an array with elements dispersed uniformly along a line with λ/2 spacing (such as the dipole arrays on each edge of the ground plane in FIG. 6 for 28 GHz dipoles), assuming that the elements of the array have isotropic radiation pattern in the plane of interest, it is possible to steer the beam in a particular direction by setting a magnitude of the signal fed to each antenna port equal to 1 volt with a progressive phase shift (e.g., if the phase of the first antenna element is zero, then the phase shift of the second antenna element will be α (degrees), the phase shift of the third antenna element will be 2α, and so on. The value of a may determine the direction of the beam. Assuming that the angle of the beam is measured with respect to a line that connects all the antenna elements together, then α may be −180 degrees for the beam to be along this line. For the beam to make 30, 45, 60 and 90 degree angles with this line, for example, the progressive phase shift may be −155.9, −127.3 −90, and 0 degrees, respectively. Thus, if the antenna elements are fed in phase (i.e., α equals zero degrees), then the beam will be in the direction perpendicular to the direction of the array line. Such numbers may be based on another assumption that there is no mutual coupling among the antenna elements. In practice, (the level of) mutual coupling among the elements of the array may result in modifications to such angles or different phase shifts to achieve such beam angles.

When the antenna arrays 730 are configured with separate antenna arrays for different operating frequencies (e.g., two different frequencies, such as 28 GHz and 60 GHz as described herein), the transceiver(s) 725 may selectively operate the antenna arrays (as well as their individual elements) corresponding to the frequency currently being used by the UE 115-*a* for communications. With the dual-frequency antenna structures described herein, the UE 115-*a* may communicate over two different bands without a separate antenna structure for each band. Thus, the antenna structures described herein may conserve the limited real estate of the UE 115-*a* and may reduce any potential negative impact on the overall size of the UE 115-*a* that may otherwise be incurred to provide such capabilities.

The communications manager 720 and/or the transceiver (s) 725 of the UE 115-*a* may, individually or collectively, be implemented using one or more application-specific integrated circuits (ASICs) adapted to perform some or all of the applicable functions in hardware. Alternatively, the functions may be performed by one or more other processing units (or cores), on one or more integrated circuits. In other examples, other types of integrated circuits may be used (e.g., Structured/Platform ASICs, Field Programmable Gate Arrays (FPGAs), and other Semi-Custom ICs), which may be programmed in any manner known in the art. The functions of each module may also be implemented, in whole or in part, with instructions embodied in a memory, formatted to be executed by one or more general or application-specific processors.

Figure 8:
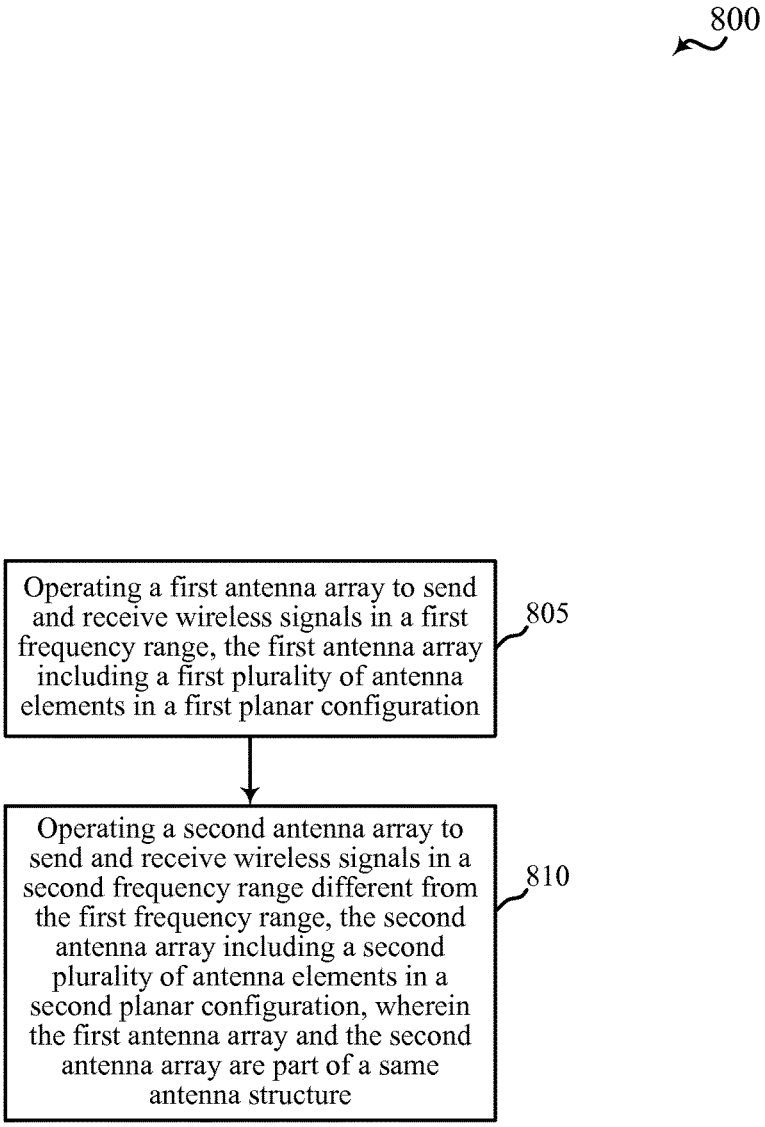
FIG. 8 is a flow chart illustrating an example of a method for wireless communication, in accordance with various aspects of the present disclosure.

FIG. 8 is a flow chart illustrating an example of a method 800 for wireless communication, in accordance with various aspects of the present disclosure. For clarity, the method 800 is described below with reference to aspects of one or more of the antenna structures described above. In some examples, a UE may execute one or more sets of codes to control the functional elements of the UE to perform the functions described below. Additionally or alternatively, the UE may perform one or more of the functions described below using special-purpose hardware.

At block 805, the method 800 may involve operating a first antenna array to send and receive wireless signals in a first frequency range. The first antenna array may include a first plurality of antenna elements in a first planar configuration. For example, the first antenna array may be the first array of antenna elements 310 described with respect to FIG. 3.

At block 810, the method 800 may involve operating a second antenna array to send and receive wireless signals in a second frequency range different from the first frequency range. The second antenna array may include a second plurality of antenna elements in a second planar configuration. For example, the second antenna array may be the second array of antenna elements 320 described with respect to FIG. 3.

According to the method 800, the first antenna array and the second antenna array are part of a same antenna structure, for example, as described with respect to FIG. 3. Thus, the method 800 may provide for wireless communication in two different frequency ranges using a single antenna structure. As described above, such an antenna structure may provide such capability while remaining compact, which may help conserve the limited real estate available in a modern wireless communication device.

The operation(s) at blocks 805 and 810 may be performed using the transceiver(s) 725 described with reference to FIG. 7. While a single transceiver 725 may be used, separate transceivers for operating the first antenna array and for operating the second antenna array, particularly when the antenna elements of the respective arrays are individually fed, for example, to steer a beam from the respective array in a desired direction(s).

It should be noted that the method 800 is just one implementation and that various other operations according to the foregoing disclosure may be performed in addition to, or instead of, the operation(s) at blocks 805 and 810. As such, other methods are possible.

While the foregoing description refers to specific operating frequencies of 28 GHz and 60 GHz, it should be understood that such operating frequencies may correspond to a range of frequencies. For example, an operating frequency around 28 GHz may involve a range of frequencies such as 27-31 GHz, and an operating frequency around 60 GHz may involve a range of frequencies such as 56-67 GHz. Such ranges may depend, at least in part, on the particular designs and configurations of the antenna elements and the antenna element arrays such as those described herein.

Techniques described herein may be used for various wireless communications systems such as CDMA, TDMA, FDMA, OFDMA, SC-FDMA, and other systems. The terms "system" and "network" are often used interchangeably. A CDMA system may implement a radio technology such as CDMA2000, Universal Terrestrial Radio Access (UTRA), etc. CDMA2000 covers IS-2000, IS-95, and IS-856 standards. IS-2000 Releases 0 and A are commonly referred to as CDMA2000 1×, 1×, etc. IS-856 (TIA-856) is commonly referred to as CDMA2000 1×EV-DO, High Rate Packet Data (HRPD), etc. UTRA includes Wideband CDMA (WCDMA) and other variants of CDMA. A TDMA system may implement a radio technology such as Global System for Mobile Communications (GSM). An OFDMA system may implement a radio technology such as Ultra Mobile Broadband (UMB), Evolved UTRA (E-UTRA), IEEE 802.11 (WiFi), IEEE 802.16 (WiMAX), IEEE 802.20, Flash-OFDM™, etc. UTRA and E-UTRA are part of Universal Mobile Telecommunication System (UMTS). 3GPP Long Term Evolution (LTE) and LTE-Advanced (LTE-A) are new releases of UMTS that use E-UTRA. UTRA, E-UTRA, UMTS, LTE, LTE-A, and GSM are described in documents from an organization named "3rd Generation Partnership Project" (3GPP). CDMA2000 and UMB are described in documents from an organization named "3rd Generation Partnership Project 2" (3GPP2). The techniques described herein may be used for the systems and radio technologies mentioned above as well as other systems and radio technologies, including cellular (e.g., LTE) communications over an unlicensed and/or shared bandwidth. The description above, however, describes an LTE/LTE-A system for purposes of example, and LTE terminology is used in much of the description above, although the techniques are applicable beyond LTE/LTE-A applications.

The detailed description set forth above in connection with the appended drawings describes examples and does not represent the only examples that may be implemented or that are within the scope of the claims. The terms "example" and "exemplary," when used in this description, mean "serving as an example, instance, or illustration," and not "preferred" or "advantageous over other examples." The detailed description includes specific details for the purpose of providing an understanding of the described techniques. These techniques, however, may be practiced without these specific details. In some instances, well-known structures and apparatuses are shown in block diagram form in order to avoid obscuring the concepts of the described examples.

Information and signals may be represented using any of a variety of different technologies and techniques. For example, data, instructions, commands, information, signals, bits, symbols, and chips that may be referenced throughout the above description may be represented by voltages, currents, electromagnetic waves, magnetic fields or particles, optical fields or particles, or any combination thereof.

The various illustrative blocks and components described in connection with the disclosure herein may be implemented or performed with a general-purpose processor, a digital signal processor (DSP), an ASIC, an FPGA or other programmable logic device, discrete gate or transistor logic, discrete hardware components, or any combination thereof designed to perform the functions described herein. A general-purpose processor may be a microprocessor, but in the alternative, the processor may be any conventional processor, controller, microcontroller, or state machine. A processor may also be implemented as a combination of computing devices, e.g., a combination of a DSP and a microprocessor, multiple microprocessors, one or more microprocessors in conjunction with a DSP core, or any other such configuration.

The functions described herein may be implemented in hardware, software executed by a processor, firmware, or any combination thereof. If implemented in software executed by a processor, the functions may be stored on or transmitted over as one or more instructions or code on a computer-readable medium. Other examples and implementations are within the scope and spirit of the disclosure and appended claims. For example, due to the nature of software, functions described above can be implemented using software executed by a processor, hardware, firmware, hardwiring, or combinations of any of these. Features implementing functions may also be physically located at various positions, including being distributed such that portions of functions are implemented at different physical locations. As used herein, including in the claims, the term "and/or," when used in a list of two or more items, means that any one of the listed items can be employed by itself, or any combination of two or more of the listed items can be employed. For example, if a composition is described as containing components A, B, and/or C, the composition can contain A alone; B alone; C alone; A and B in combination; A and C in combination; B and C in combination; or A, B, and C in combination. Also, as used herein, including in the claims, "or" as used in a list of items (for example, a list of items prefaced by a phrase such as "at least one of" or "one or more of") indicates a disjunctive list such that, for example, a list of "at least one of A, B, or C" means A or B or C or AB or AC or BC or ABC (i.e., A and B and C).

Computer-readable media includes both computer storage media and communication media including any medium that facilitates transfer of a computer program from one place to another. A storage medium may be any available medium that can be accessed by a general purpose or special purpose computer. By way of example, and not limitation, computer-readable media can comprise RAM, ROM, EEPROM, flash memory, CD-ROM or other optical disk storage, magnetic disk storage or other magnetic storage devices, or any other medium that can be used to carry or store desired program code means in the form of instructions or data structures and that can be accessed by a general-purpose or special-purpose computer, or a general-purpose or special-purpose processor. Also, any connection is properly termed a computer-readable medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. Disk and disc, as used herein, include compact disc (CD), laser disc, optical disc, digital versatile disc (DVD), floppy disk and Blu-ray disc where disks usually reproduce data magnetically, while discs reproduce data optically with lasers. Combinations of the above are also included within the scope of computer-readable media.

The previous description of the disclosure is provided to enable a person skilled in the art to make or use the disclosure. Various modifications to the disclosure will be readily apparent to those skilled in the art, and the generic principles defined herein may be applied to other variations without departing from the scope of the disclosure. Thus, the disclosure is not to be limited to the examples and designs described herein but is to be accorded the broadest scope consistent with the principles and novel features disclosed herein.

What is claimed is:

1. An apparatus for wireless communication, comprising:

a first antenna array comprising a first plurality of antenna elements in a first planar configuration and adapted to send and receive wireless signals in a first frequency range, wherein at least one of the first plurality of antenna elements comprises a microstrip patch antenna that comprises a first patch element and a second patch element parasitically coupled to the first patch element;

a second antenna array comprising a second plurality of antenna elements in a second planar configuration and adapted to send and receive wireless signals in a second frequency range, the second frequency range being different from the first frequency range; and a configuration wherein the first and second antenna arrays together comprise a dual aperture antenna array.

2. The apparatus of claim 1, wherein the second antenna array is positioned in a plane that is different from the first antenna array.

3. The apparatus of claim 1, wherein the first planar configuration is parallel to the second planar configuration.

4. The apparatus of claim 1, wherein the first antenna array comprises at least two of the first plurality of antenna elements in a first lateral dimension and at least two of the first plurality of antenna elements in a second lateral dimension.

5. The apparatus of claim 1, wherein at least one of the first plurality of antenna elements defines an aperture, and at least one of the second plurality of antenna elements is laterally aligned within the aperture and is vertically offset from the aperture.

6. The apparatus of claim 1, wherein at least one of the first plurality of antenna elements defines an aperture, and at least one of the second plurality of antenna elements is laterally adjacent to the aperture and vertically offset from the aperture.

7. The apparatus of claim 1, wherein the first patch element defines a first aperture, wherein the second patch element defines a second aperture, and wherein the first aperture and the second aperture are laterally aligned and vertically spaced from one another.

8. The apparatus of claim 1, wherein the first frequency range includes 27-31 gigahertz.

9. The apparatus of claim 1, wherein at least one of the second plurality of antenna elements comprises a microstrip E-patch antenna defining a plurality of planar sections connected by a shared edge.

10. The apparatus of claim 1, wherein the second frequency range includes 56-67 gigahertz.

11. The apparatus of claim 1, wherein the second antenna array further comprises one or more additional antenna elements positioned in a middle column of the second array.

12. The apparatus of claim 1, wherein one or more of the first plurality of antenna elements and one or more of the second plurality of antenna elements are oriented in a mirror symmetry pattern with respect to one another.

13. The apparatus of claim 1, wherein at least some of the second plurality of antenna elements are arranged in a triangular lattice configuration.

14. The apparatus of claim 1, further comprising a ground plane coupled to the first and second antenna arrays.

15. The apparatus of claim 14, wherein the ground plane comprises one or more folded dipoles adapted to send and receive wireless signals in the first frequency range and one or more folded dipoles adapted to send and receive wireless signals in the second frequency range.

16. The apparatus of claim 1, wherein the apparatus comprises a user equipment (UE) and the first and second antenna arrays are positioned within the UE.

17. The apparatus of claim 1, wherein each of the first antenna array and the second antenna array is configured to steer a narrow beam for millimeter wave wireless communication.

18. The apparatus of claim 1, further comprising:

a third antenna array comprising a third plurality of antenna elements in a third planar configuration and adapted to send and receive wireless signals in the first frequency range; and a fourth antenna array comprising a fourth plurality of antenna elements in a fourth planar configuration and adapted to send and receive wireless signals in the second frequency range;

wherein the first and second antenna arrays are configured to send and receive wireless signals in a broadside direction and the third and fourth antenna arrays are configured to send and receive wireless signals in an end-fire direction.

19. The apparatus of claim 1, wherein at least one of the first and second frequency range is within the millimeter wavelength (mmW) spectrum.

20. A method for wireless communication, comprising:

operating a first antenna array to send and receive wireless signals in a first frequency range, the first antenna array including a first plurality of antenna elements in a first planar configuration, wherein at least one of the first plurality of antenna elements comprises a microstrip patch antenna that comprises a first patch element and a second patch element parasitically coupled to the first patch element; and operating a second antenna array to send and receive wireless signals in a second frequency range different from the first frequency range, the second antenna array including a second plurality of antenna elements in a second planar configuration;

wherein the first and second antenna arrays together comprise a dual aperture antenna array; and wherein the first antenna array and the second antenna array are part of a same antenna structure.

21. The method of claim 20, wherein at least one of the first and second frequency range is within the millimeter wavelength (mmW) spectrum.

22. A non-transitory computer-readable medium storing computer-executable code for wireless communication, the code executable by a processor to cause a device to:

control an antenna structure including a first antenna array comprising a first plurality of antenna elements in a first planar configuration and a second antenna array comprising a second plurality of antenna elements in a second planar configuration, wherein the first and second antenna arrays together comprise a dual aperture antenna array, wherein at least one of the first plurality of antenna elements comprises a microstrip patch antenna that comprises a first patch element and a second patch element parasitically coupled to the first patch element, and wherein such control operates the first antenna array to send and receive wireless signals in a first frequency range and operates the second antenna array to send and receive wireless signals in a second frequency range different from the first frequency range.

23. The non-transitory computer-readable medium of claim 22, wherein at least one of the first and second frequency range is within the millimeter wavelength (mmW) spectrum.

* * * * *